United States Patent [19]

MacDonald et al.

[11] Patent Number: 4,875,554

[45] Date of Patent: Oct. 24, 1989

[54] DYNAMIC SELECTION OF ELEVATOR CALL ASSIGNMENT SCAN DIRECTION

[75] Inventors: Robert C. MacDonald, W. Caldwell, N.J.; Elsa Abrego, Manhattan, N.Y.

[73] Assignee: Inventio AG, Hergiswil, Switzerland

[21] Appl. No.: 238,941

[22] Filed: Aug. 31, 1988

[51] Int. Cl.[4] ..... B66B 1/18

[52] U.S. Cl. ..... 187/124; 187/127

[58] Field of Search ..... 187/124, 127, 129

[56] References Cited

U.S. PATENT DOCUMENTS

| | | | |
|---|---|---|---|
| 3,614,997 | 10/1971 | Lusti | 187/124 |
| 3,750,850 | 8/1973 | Winkler et al. | 187/129 |
| 3,804,209 | 4/1974 | Edison | 187/127 |
| 4,029,175 | 6/1977 | Winkler | 187/127 |
| 4,037,688 | 7/1977 | Winkler | 187/127 |
| 4,401,190 | 8/1983 | Bittar | 187/127 |
| 4,463,834 | 8/1984 | Polis et al. | 187/127 |
| 4,638,889 | 1/1987 | Ludwig et al. | 187/127 |

*Primary Examiner*—William M. Shoop, Jr.
*Assistant Examiner*—W. E. Duncanson, Jr.
*Attorney, Agent, or Firm*—D. R. Lackey

[57] ABSTRACT

A method of assigning hall calls to a plurality of elevator cars (0, 1, N) which biases the assignment process to balance the number of cars serving up and down service directions. Prior to each call assignment update the method determines the number of cars serving each service direction (78, 80, 82). A predetermined relationship (88) between there two numbers is used to determine if up hall calls should be assigned first, or down hall calls (90, 92, 94, 96). The balancing of cars serving the two service directions lowers the average waiting time, and it results in dispersing the cars throughout a building when service subsides, to enable prompt service for newly entered calls without the necessity of moving the cars during periods of low service to be in position for new calls.

8 Claims, 5 Drawing Sheets

24
22
34
FLOOR # N
36
20
FLOOR # 1
30
32
CAR 0
CAR 1
CAR N
FLOOR # 0
26
CC
CC
CC
1Z , 2Z
3Z
40
38
INPUT INTERFACE
ADDRESS
28
INTERRUPT
DATA
46
44
39
42
ROM
RAM
OUTPUT PORT
INPUT PORT
CPU
CONTROL
DATA

DYNAMIC SELECTION OF ELEVATOR CALL ASSIGNMENT SCAN DIRECTION

TECHNICAL FIELD

The invention relates in general to dispatching strategies for elevator systems of the hydraulic and traction type, and more specifically to a method of efficiently assigning up and down hall calls registered from the floors of a building to a group of elevator cars which provide elevator service for the building.

BACKGROUND ART

Regardless of the dispatching strategy used to assign up and down hall calls registered from the floors of a building to a group of elevator cars, in the absence of up or down peak traffic conditions, it would be desirable to balance the number of cars serving up demands with the number of cars serving down demands, to achieve an improved distribution of cars throughout a building and hence a lower average waiting time (AWT). The AWT is the industry standard for measuring the efficiency of elevator systems.

Other then in a morning up peak condition, which initiates well known special strategies for quickly returning cars to a traffic entry floor, ie., lobby floor, and in the absence of an evening down peak condition, which also initiates known special strategies for quickly de-populating a building, a balanced distribution of elevator cars will more efficiently serve existing hall calls. When traffic subsides and then picks up, the cars will already be dispersed throughout the building and in a better position to quickly serve new hall calls.

Some dispatching strategies deliberately move the elevator cars to predetermined floors of the building when traffic subsides, ie., during an off peak traffic condition, called "spotting". Spotting is inefficient, as the cars are doing no useful work during their travel to the preselected floors. In addition, they are wasting energy are creating unnecessary wear and tear which increases maintenance costs.

A dispatching strategy which is attractive because of its simplicity, and which would at first appear to be a very efficient strategy, estimates the time of arrival (ETA) of each elevator car at the floor of a specific hall call to be assigned. The hall call assignment is given to the elevator car having the lowest ETA. The call assignments are continuously reevaluated, and when a previously assigned hall call is being reconsidered, reassignment to another car is only made to another car having a lower ETA when the lower ETA is lower by T seconds.

The ETA strategy, however, can lead to car distribution problems. Cars can bunch or cluster and race one another to answer hall calls. This leads to leap frogging and "no-call stops" in which a car stops only to find another car has just arrived to serve the same call.

The present invention relates to improving elevator dispatching strategies in general, and to improving the ETA strategy in particular, and it is an object of the invention to improve car distribution in a building by incorporating the improvement in the assignment process itself, reducing the need to artificially spot cars throughout a building.

The following co-pending applications, which are assigned to the same assignee as the present application, are also directed to improvement of the ETA strategy, with the present invention complementing the methods disclosed therein:

(1) Application Serial No. 168,791, filed March 16, 1988, entitled "Coincident Call Optimization In An Elevator System";

(2) Application Serial No. 168,817, filed March 16, 1988, entitled "Dynamic Assignment Switching In The Dispatching Of Elevator Cars";

(3) Application Serial No. 169,206, filed March 16, 1988, entitled "Method For Using Door Cycle Time In Dispatching Elevator Cars"; and (4) Application Serial No. 169,210, filed March 16, 1988, entitled "Anti-bunching Method For Dispatching Elevator Cars".

Application Serial No. 168,817 is hereby incorporated into the specification of the present application by reference.

DISCLOSURE OF THE INVENTION

Briefly, the present invention is a method for balancing the number of elevator cars serving up demands, ie., car and hall calls, in a building, with the number of cars serving down demands, to achieve an improved distribution of cars in the building and a lower average waiting time (AWT) while the cars are busy, and also while they are waiting for elevator traffic to build. The invention determines the number of cars serving up demands (UPCOUNT), and the number of cars serving down demands (DNCOUNT), and an initial hall call assignment direction is dynamically selected for each assignment update based upon a predetermined relationship between UPCOUNT AND DNCOUNT. In a preferred embodiment, this relationship includes the steps of determining if UPCOUNT exceeds DNCOUNT, and if UPCOUNT exceeds DNCOUNT, the assignment sequence starts by initially scanning for down hall calls. Up and down hall calls are stored in a call table, in the same order as the floors of the building to which they relate. The down call assignment procedure starts the scanning process at the "top floor" of the call table and it proceeds downwardly through the floors of the building until reaching the next to the bottom floor, ie., the bottom floor +1. After scanning for down calls, the assignment process continues by scanning for up hall calls. The up call assignment procedure starts the scanning process at the "bottom floor" of the call table and it proceeds upwardly through the floors of the building until reaching the next to the top floor, i.e., the top floor −1.

If the determining step finds that UPCOUNT does not exceed DNCOUNT, then the sequence of scanning the building represented by the call table is reversed, starting the scanning procedure at the bottom floor and scanning upwardly for up hall calls, and upon reaching the top floor −1, the procedure starts at the top floor and scans down, assigning down hall calls until reaching the bottom floor +1.

Before the assignment process is updated, the relationship between UPCOUNT and DNCOUNT is again determined, and the scanning sequence is selected accordingly. Thus, when car distribution favors the up service direction, the assignment process favors the down service direction, and vice versa, automatically building in a balanced car distribution factor into the call assignment process.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

The invention will be described relative to an ETA dispatching system, because of the ability of the invention to reduce car bunching problems, to which such systems are susceptible. The invention, however, may be applied to any dispatching system in which up and down hall call tables are scanned and sequentially assigned to elevator cars based upon some type of strategy.

Figure 1:
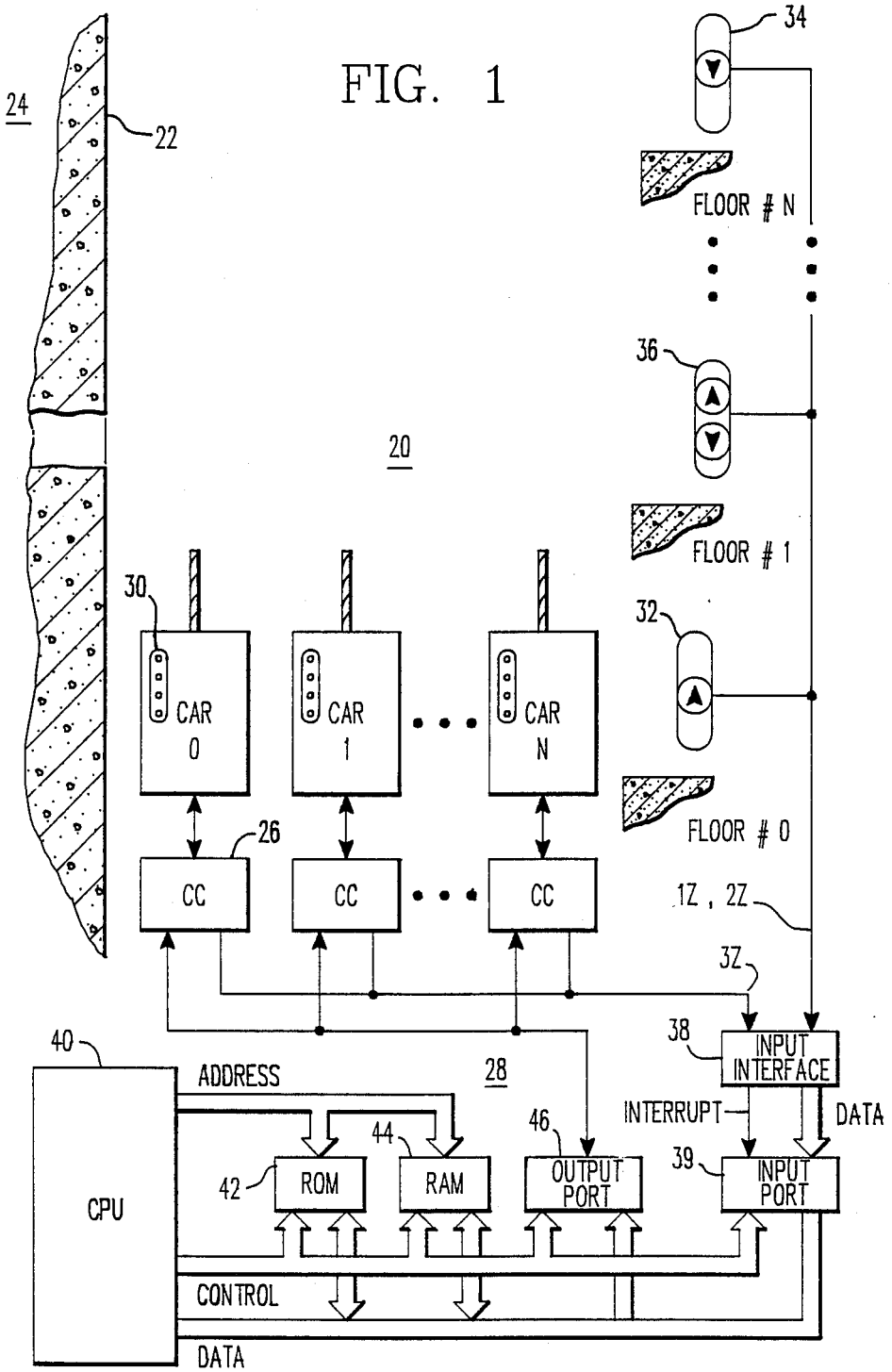
FIG. 1 is a diagrammatic representation of an elevator system which may utilize the teachings of the invention.

Referring now to the drawings, and to FIG. 1 in particular there is shown an elevator system 20 which may benefit from the teachings of the invention. Elevator system 20 includes a plurality of elevator cars #O through #N mounted for guided up and down travel in hatchways 22 of a building 24 to serve the floors therein numbered 0 through N, with floor 0 being the bottom floor and floor N being the top floor. Elevator cars #O through #N, which cars may be of the hydraulic type, or of the traction type, as desired, each have a car controller, such as car controller 26 associated with car #O. The plurality of elevator cars #O through #N are placed under group control by a system processor 28. A car controller which may be used for car controller 26 is shown in U.S. Pat. 3,750,850, with modifications thereof for group control by a system processor, including data links, being shown in U.S. Pat. No. 3,804,209. U.S. Pat. Nos. 3,750,850 and 3,804,209, which are assigned to the same assignee as the present application, are hereby incorporated into the specification of the present application by reference. An elevator system which may also be used in set forth in co-pending Application Serial No. 109,638 filed Oct. 16, 1987, entitled "Elevator System Master Car Switching", which is assigned to the same assignee as the present application. In this latter elevator system, the car controller of each car is capable of being the dispatcher for the group, with one car always being automatically selected as the dispatcher.

Car calls are registered in the elevator cars #0 through #N via suitable push button arrays, such as push button array 30 in car #0.

Hall calls are registered from suitable push buttons located at the various floors of building 24, such as an up hall call push button 32 located at the bottom floor (floor #O), a down hall call push button 34 located at the top floor (floor #N), and up and down hall call buttons 36 located at each of the intermediate floors. The up and down hall calls may be serialized and transmitted to an input interface 38 of system processor 28 as signals 1Z and 2Z. The car calls registered in each of the cars may be serialized and transmitted to input interface 38 along with other per-car related information as signal 3Z. The per-car information includes car status signals, such as a signal INSV which is true when the associated car is in service; a signal UPTR which is a logic one when the associated car is set for up travel and a logic zero when it is set for down travel; a signal AVAS when an in-service elevator car is stationary, not busy and available for assignment, ie., the car has no car calls and no assigned hall calls; a signal AVP which gives the advanced position of the associated elevator car in binary. The per-car information also includes floor enable signals FEN which indicate which floors of the building 24 the associated car is enabled to serve. The floor enable signals may be set in memory tracks in the car controllers, or at a traffic director's station (not shown), as desired System processor 28, in addition to input interface 38, includes a central processing unit (CPU) 40, a read-only memory 42 (ROM), a random-access memory 44 (RAM), and an output port 46.

Figure 4:
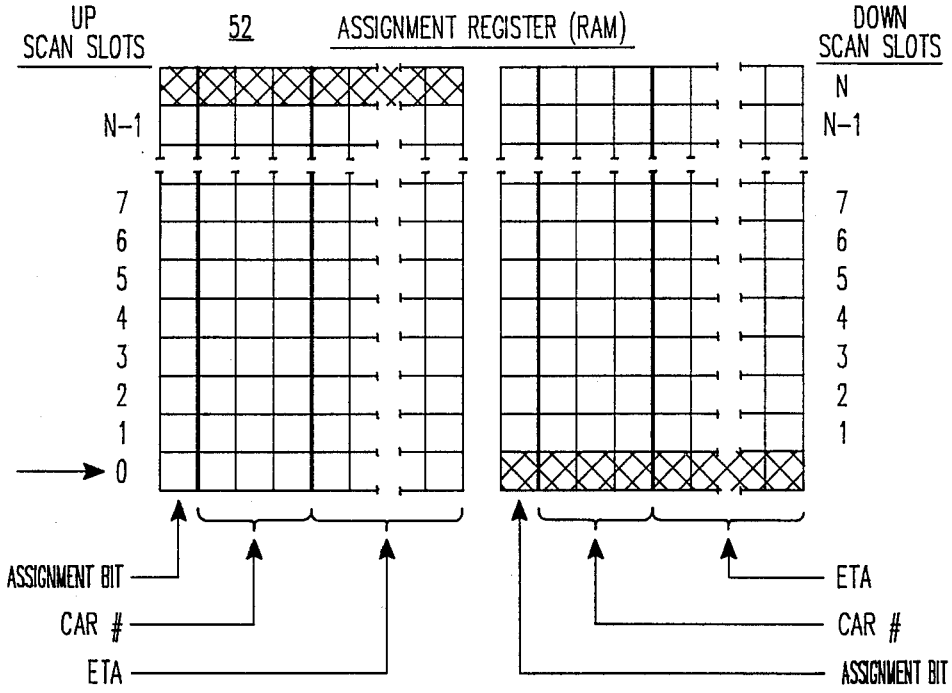
FIG. 4 is a RAM map of an assignment register used by the programs of FIGS. 7–9.
Figure 2:
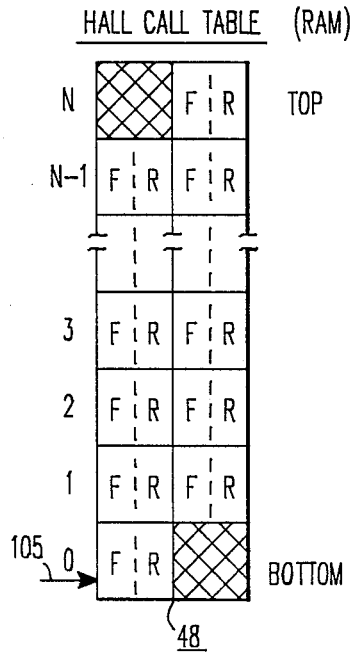
FIG. 2 is a RAM map of a hall call table used by the programs of FIGS. 7–9.
Figure 3:
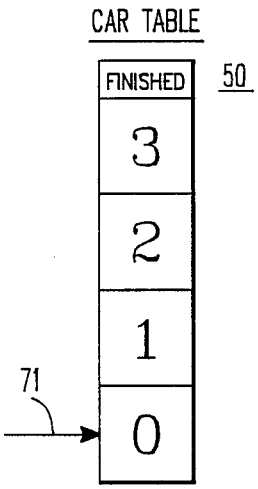
FIG. 3 is a RAM map of a car table used by the programs of FIGS. 7–9.

System processor 28 prepares a hall call table 48 shown in FIG. 2, a car table 50 shown in FIG. 3, and an assignment register 52 shown in FIG. 4. The hall call table 48 may be integrated into the assignment register 52 if desired, by adding a "call" bit next to the assignment bit in both the up and down call portions of the register.

Figure 5:
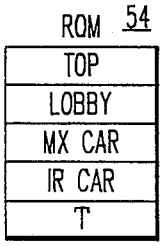
FIG. 5 is a ROM map listing initial values or fixed values used by the programs of FIGS. 7–9.

FIG. 5 is a ROM map 54 which includes a list of constants stored in ROM which pertain to the specific elevator system 20. The constants include the time T in seconds by which the lowest ETA for a hall call must be lower than the ETA of a different car which was previously assigned to serve the hall call being considered, before the assignment will be switched to the different car. The constants also include the car number, or car numbers, of cars preselected to serve calls placed from an inconspicuous riser, if any. The constants also include the floor numbers which are associated with the top and lobby floors of the building, and the number of cars (MXCAR) in the elevator system which are under group control.

Figure 6:
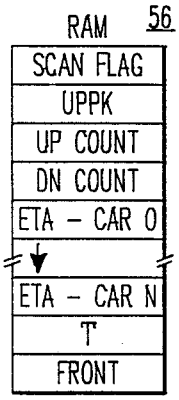
FIG. 6 is a RAM map listing variables used by the programs set forth in FIGS. 7, 8 and 9 which implement the teachings of the invention.
Figure 7:
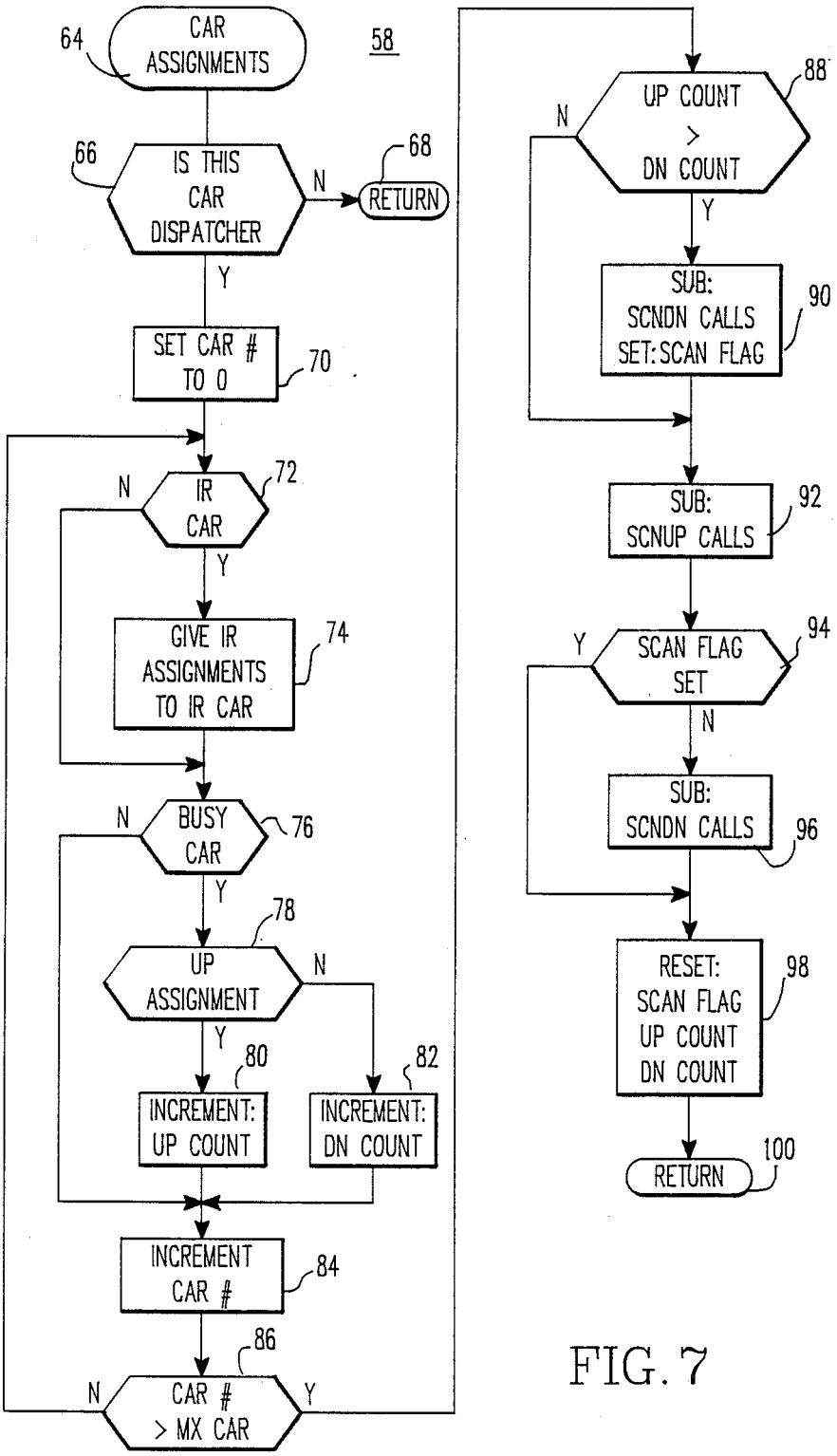
FIG. 7 is a flow chart of a program which dynamically selects a hall call assignment sequence according to the teachings of the invention.
Figure 8:
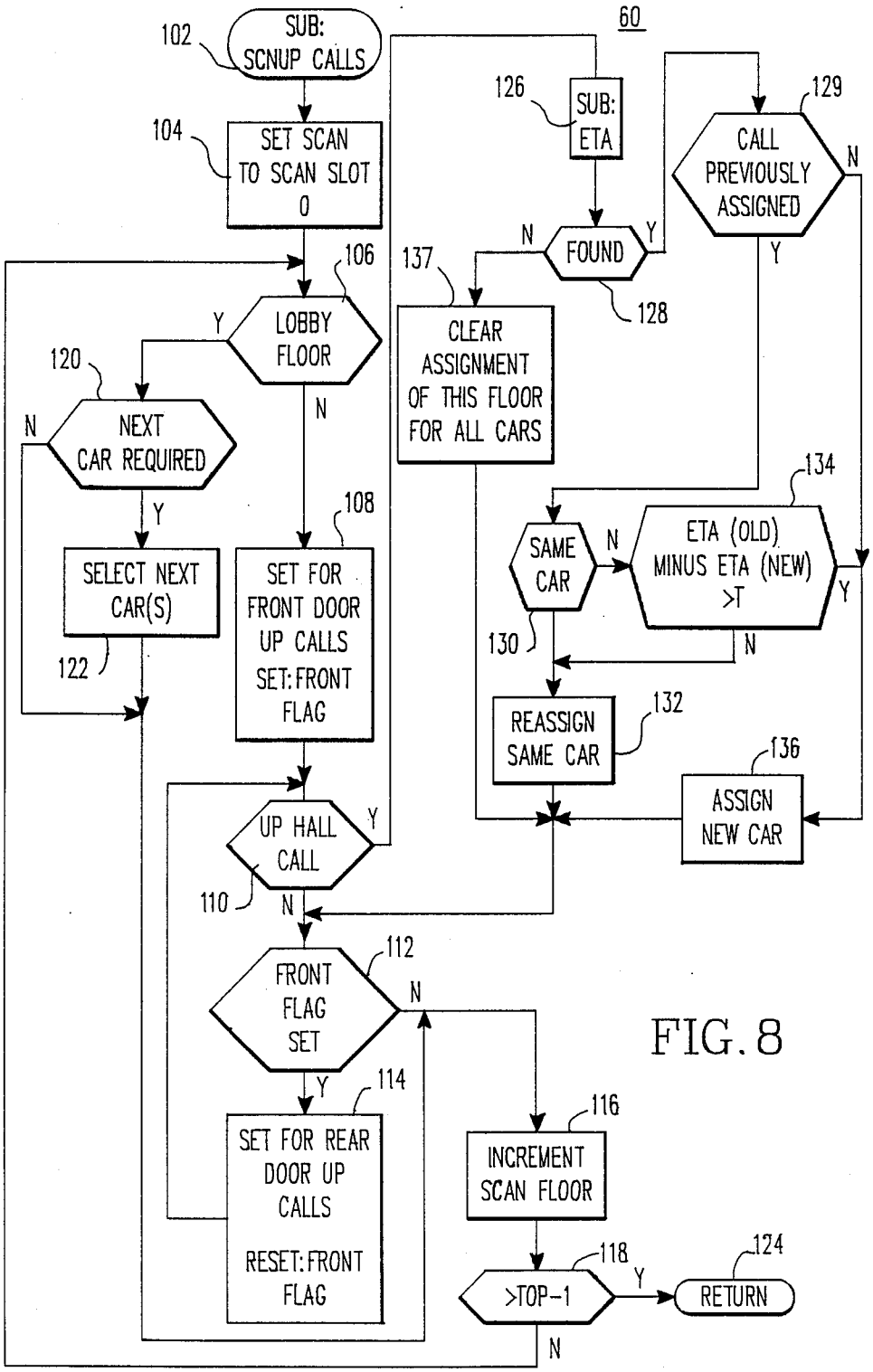
FIG. 8 is a flow chart of a subroutine called by the program FIG. 7 to assign up hall calls.
Figure 9:
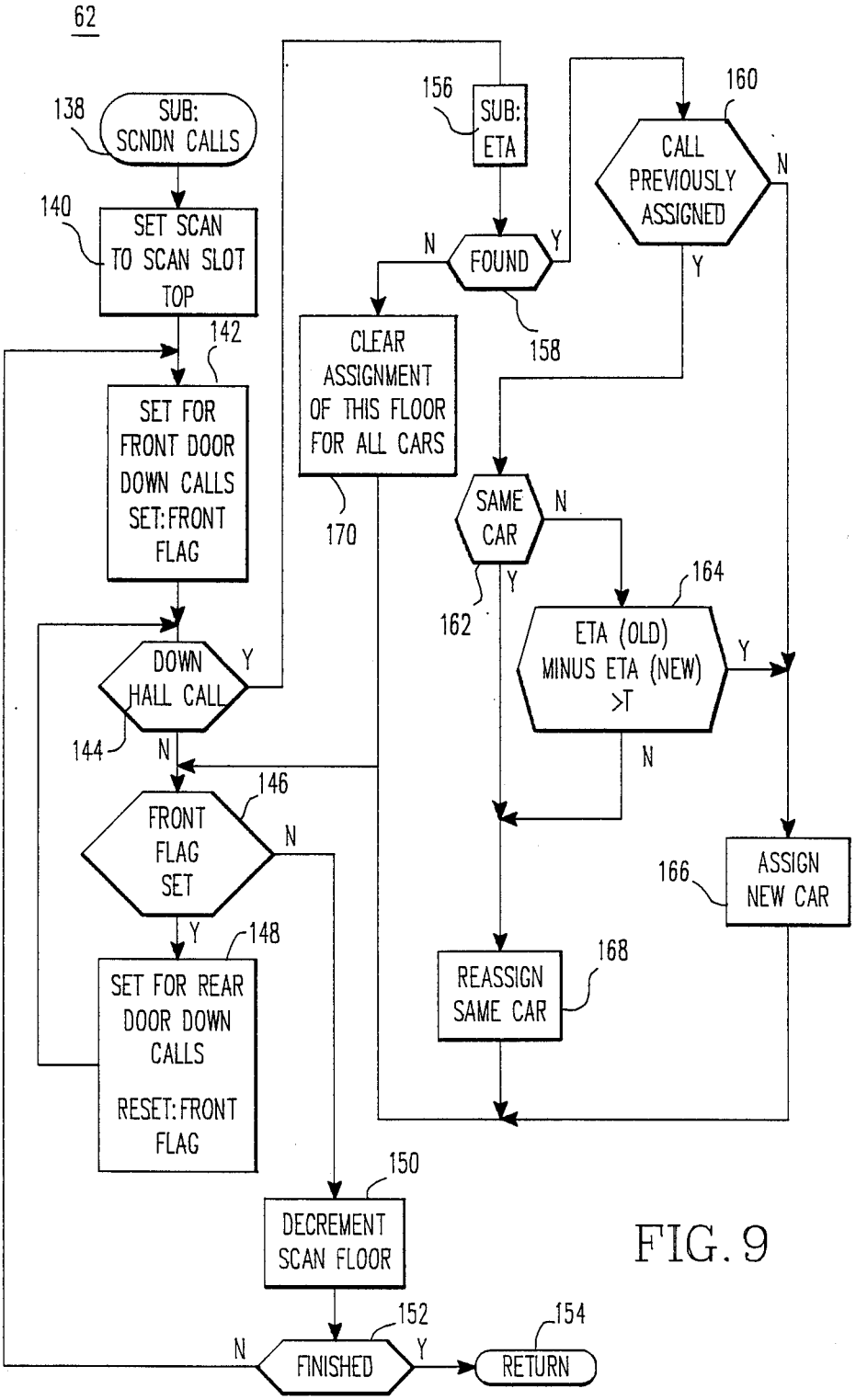
FIG. 9 is a flow chart of a subroutine called by the program of FIG. 7 to assign down hall calls.

FIG. 6 is a RAM map 56 illustrating certain variables used by the programs of FIGS. 7–9. T is listed as a variable, in the event the teachings of the incorporated patent application Serial No. 168,817 are utilized, which dynamically determines T to minimize AWT.

FIGS. 7, 8 and 9 are flow charts of programs 58, 60 and 62, respectively, which are stored in ROM 42, and which are run along with other programs stored in ROM 42 which are not pertinent to the teachings of the invention. Such other programs include programs set forth in the incorporated patent application Serial No. 168,817 for determining the ETA's of the cars relative to each hall call to be assigned.

More specifically, program 58 set forth in FIG. 7, which is run prior to each updating of hall call assignments, dynamically determines the scanning sequence to be used for each update of the hall call assignment process. Program 58 is entered at 64 and step 66 checks to see if the car running the program is currently being designated as the dispatcher. If the car running the program is not the dispatcher, the program quickly exits at 68. These steps are based upon the assumption that all cars have the capability of being a dispatcher, as set forth in the hereinbefore mentioned application Serial No. 109,638. It there is a separate dispatcher function, then steps 66 and 68 would not be required.

Program 58 continues with step 70 setting a pointer to car #O of the car table 50 shown in FIG. 3, such as pointer 71. If there is an inconspicuous riser (IR) for entering hall calls, steps 72 and 74 recognize when calls have been placed on the IR, and assignments of the IR calls are made to the IR car. Step 76 determines if the car being considered is serving a demand, with a demand including an assigned hall call and/or a registered car call. If the car is serving a demand, step 78 determines if the car is serving the up service direction. If it is, a software counter UPCOUNT, indicated in RAM map 56 of FIG. 6 is incremented by step 80. If the car is not serving the up service direction, it is serving the down service direction and step 82 increments a software counter DNCOUNT, also set forth in FIG. 6.

Steps 80 and 82 both proceed to step 84 which increments pointer 71 to the next car in the car table. Step 76 also proceeds to step 84 when the car being considered is not in the process of serving a demand for elevator service. Such a car may be out of service (INSV will not be true), or it may simply be idle or available for service (AVAS will be true). After step 84 increments the car table, step 86 checks to see if the table is finished, i.e., whether or not all cars under group control have been considered. If step 86 finds that the car number has not been incremented beyond the maximum car number MXCAR, the program returns to step 72 to process the next car. When all cars have been considered, the program advances to step 88.

Step 88 determines if a predetermined relationship exists between UPCOUNT and DNCOUNT. In a preferred embodiment of the invention, this predetermined relationship involves the determination of whether UPCOUNT exceeds DNCOUNT, which favors the up travel direction in the event of a tie. Of course, step 88 could favor the down travel direction by determining whether DNCOUNT exceeds UPCOUNT. If UPCOUNT exceeds DNCOUNT, step 90 calls the subroutine SCNDNCALLS, which is the program 62 set forth in FIG. 9. Thus, down hall calls are processed first, favoring the down service direction because there are more cars serving the up service direction. Step 90 also sets a flag SCANFLAG, set forth in RAM map 56 of FIG. 6.

Step 90, after assigning down calls, then proceeds to step 92 which calls the subroutine SCNUPCALLS, which is the program 60 set forth in FIG. 8. Step 92 thus completes the assignment update on this running of program 58. Step 94 determines if flag SCANFLAG is set. If it is, it indicates that both up and down hall alls have been assigned, and step 94 proceeds to step 98 which resets SCANFLAG, UPCOUNT and DNCOUNT, and the program exits at 100.

If UPCOUNT does not exceed DNCOUNT, then the up travel direction is favored and step 88 proceeds to step 92 which calls the subroutine SCNUPCALLS, to process up hall calls before down hall calls. Step 94 will find that the flag SCANFLAG is not set, indicating that down hall calls have not yet been processed, and step 94 proceeds to step 96 which calls the subroutine SCNDNCALLS. Step 96 then proceeds t the resetting steps performed by step 98, and the program exits at 100.

The subroutine SCNUPCALLS called by step 92 of program 58 is entered at 102 of program 60 shown in FIG. 8, and step 104 sets pointer 105 to floor #O of the hall call table 48, as shown in FIG. 2.

If there are 20 floors in the building, for example, the highest floor which could have an up hall call would be floor #18, when assigning #0 to the lowest floor. The lowest floor which can have a down hall call is the bottom floor +1, or floor #1.

After step 104 initializes the hall call table to process up hall calls, step 106 determines if the floor being considered is the lobby floor, which can be determined from ROM map 54 of FIG. 5. If the floor being considered is not the lobby floor, the next step would normally be to check for a hall call. However, to accommodate elevator systems in which the cars have front and rear doors, step 108 first sets the scan of the hall call table to detect an up hall call from the front hall way door, and then sets a flag FRONT. For example, each scan slot of the call table may have two bits of information, with one bit being used for front door hall calls (F) and the other for rear door hall calls (R). Step 108 sets the scan to look at the proper bit for front door hall calls.

Step 110 checks for an up hall call. If none is found, step 112 checks the flag FRONT, to see if it is set. If it is set, it indicates that rear door up hall calls have not been processed, and step 114 sets the scan to look for a rear door up hall call in the same scan slot being considered. Step 114 also resets the flag FRONT and returns to step 110. If step 110 finds no up hall call from the rear door, step 112 will now find the flag FRONT reset, indicating both front and rear up hall calls have been checked, and step 116 increments the hall call table, ie., pointer 105. Step 118 checks to see if all hall table scan slots or building floors have been considered, 0 through N-1 (Top-1), and when they have all been considered, the program exits at 124.

When step 106 finds that the floor being considered is the lobby floor, it branches to step 120 which determines if a NEXT car is required. A NEXT car is the car designated as the next car to leave the lobby. A NEXT car will wait at the lobby floor with its doors open for a predetermined period of time. In certain instances more than one car will be required to be at the main floor. If one or more cars are required at the lobby floor, step 122 selects a car, or cars, and gives them an assignment to travel to the lobby floor, if they are not already located there. Step 122 proceeds to step 116, as does step 120 when it finds that a NEXT car is not required.

When step 110 finds an up hall call associated with the floor being considered, it branches to step 126 which calls a subroutine ETA, which may be the same as the subroutine COMPUTE disclosed in the incorporated patent application Serial No. 168,817, and this subroutine will thus not be described in detail. Subroutine ETA includes the steps of selecting a travel path for each elevator car relative to a floor having a registered hall call to be assigned, preparing a trip list for each elevator car using the travel path selected, determining the estimated time of arrival (ETA) at the call floor in question for each elevator car, and determining which car has the lowest ETA. Step 128 determines if the subroutine ETA was able to find a car to serve the call in question, and if so, step 129 checks to see if this call was previously assigned to a car. If so, step 130 determines if the car found is the same one which was previously assigned to this call. If so, step 132 reassigns the call to the same car. If step 130 finds that the lowest ETA for the call in question is associated with a different car than the one previously assigned to serve the call, then step 130 proceeds to step 134 which checks to see how much lower the ETA of the new car is than the ETA of the previously assigned car. If the difference exceeds a value T seconds, then step 134 proceeds to step 136 which assigns the call to the newly found car, and removes the assignment from the assignment register of the prior assigned car. If step 134 finds that the new ETA is not lower than the old ETA by T seconds, then step 134 proceeds to step 132, which reassigns the call to the same car. Step 132 could be eliminated, since the same car is getting the assignment and it should already have the call in its assignment register, but step 132 makes sure that something has not occurred that may have resulted in the call no longer being in the assignment register of the car. When step 129 finds that the call had not been previously assigned, step 129 proceeds directly to step 136, to assign the call to the new car. When step 128 finds that the subroutine ETA failed to find a suitable car for the call in question for some reason, then step 137 clears the assignment of this floor for all cars. Steps 132, 136 and 137 all proceed to step 112.

The subroutine SCNDNCALLS called by steps 90 and 96 of program 58 shown in FIG. 7 is entered at 138. Step 140 sets the pointer 105 of call table 48 shown in FIG. 2 to the start of the down calls. In the previous example this would be floor #19 for a 20 floor building, or, in general, floor #N. Step 142 sets pointer 105 to pick out calls from the front door, and sets the flag FRONT. Step 144 checks for a down hall call from the front hall way door. If there is no hall call, step 146 checks the flag FRONT. Step 148, finding the flag FRONT set, sets pointer 105 to detect a down hall call registered from a rear hall way door, if any, and step 148 also resets the flag FRONT. Step 144 checks to see if a down hall call from the rear door is present, and if no call is found, step 146, upon detecting the flag FRONT reset, advances to step 150 which decrements the hall call table 48. Step 152 checks to see if all floors which can register down hall calls have been checked, returning to step 142 when they have not, and exiting at 154 when they have.

When step 144 finds a down hall call, step 156 calls subroutine ETA to find a car with the lowest ETA relative to the call being considered, as hereinbefore described relative to step 126 of program 62. Step 158 determines if a suitable car was found for the call. If a car was found, step 160 determines if the call is new, or a previously assigned call. If previously assigned, step 162 checks to see if the assignment was made to the car just found to have the lowest ETA. If the car with the lowest ETA is a different car than the car previously assigned to the call, step 164 determines if the difference between the ETA's of the two cars exceeds T seconds. If it does, step 166 assigns the call to the newly found car and returns to step 146. If step 162 finds that the new car is the same as the previously assigned car, step 168 reassigns the same car and returns to step 146. Step 164, upon finding that the difference in ETA's does not exceed T seconds, branches to step 168 to reassign the same car. Step 158, when no suitable car has been found for a call, proceeds to step 170 which clears the call from the assignment registers of all cars and returns to step 146.

In summary, there has been disclosed a new method of assigning hall calls to elevator cars which dynamically determines the initial scan direction and thus which hall calls, up or down, will be favored on each update of the assignment process. The method biases the assignment process towards balancing the number of cars serving the up and down travel directions to lower the AWT while the cars are busy, and to have them end up more uniformly spread throughout a building when service demands subside, to also enable quick service to be provided newly entered calls with no unnecessary movements of the cars.

We claim:

1. A method for assigning up and down hall calls registered from floors of a building to a plurality of elevator cars which travel in up and down directions in the building to collectively provide elevator service, comprising the steps of:

determining the number (UPCOUNT) of elevator cars providing elevator service in the up travel direction, determining the number (DNCOUNT) of elevator cars providing elevator service in the down travel direction, and selecting a sequence for assigning up and down hall calls in response to a predetermined relationship between UPCOUNT and DNCOUNT.

2. The method of claim 1 wherein the selecting step includes the steps of:

determining if UPCOUNT exceeds DNCOUNT, assigning down hall calls before up hall calls when UPCOUNT exceeds DNCOUNT, and assigning up hall calls before down hall calls when UPCOUNT does not exceed DNCOUNT.

3. The method of claim 2 including the step of providing a hall call table which lists up and down hall calls in the order of their associated floors, and wherein the assigning steps include the steps of:

scanning the hall call table for up hall calls in an ascending order, from the bottom of the building towards the top, when the up hall calls are being assigned, and scanning the hall call table for down hall calls in a descending order, from the top of the building towards the bottom, when the down hall calls are being assigned.

4. The method of claim 1 including the steps of:

selecting a travel path for each elevator car relative to a floor having a registered hall call to be assigned.

preparing a trip list for each elevator car using the travel path selected, determining the time (ETA) for each elevator car to service the associated trip list and arrive at the floor of the hall call being considered for assignment, and assigning each hall call to an elevator car based upon relative ETA times.

5. A method of balancing the number of elevator cars serving up demands in a building with the number of elevator cars serving down demands, to achieve an improved distribution of elevator cars in the building in which up and down hall calls are registered from floors of the building comprising the steps of:

determining the number (UPCOUNT) of elevator cars serving up demands, determining the number (DNCOUNT) of elevator cars serving down demands, assigning up and down hall calls to the elevator cars in periodic assignment passes through the up and down hall calls, determining, prior to each assigning step, which call direction to process first, in response to a predetermined relationship between the number of elevator cars serving up demands and the number of elevator cars serving down demands.

6. The method of claim 5 wherein the selecting step includes the steps of:

determining if UPCOUNT exceeds DNCOUNT, assigning down hall calls before up hall calls when UPCOUNT exceeds DNCOUNT, and assigning up hall calls before down hall calls when UPCOUNT does not exceed DNCOUNT.

7. The method of claim 6 including the step of providing a hall call table which lists up and down hall calls in the order of their associated floors, and wherein the assigning steps include the steps of:

scanning the hall call table for up hall calls in an ascending order, from the bottom of the building towards the top, when the up hall calls are being assigned, and scanning the hall call table for down hall calls in a descending order, from the top of the building towards the bottom, when the down hall calls are being assigned.

8. The method of claim 5 including the steps of:

selecting a travel path for each elevator car relative to a floor having a registered hall call to be assigned, preparing a trip list for each elevator car using the travel path selected, determining the time (ETA) for each elevator car to service the associated trip list and arrive at the floor of the hall call being considered for assignment, and assigning each hall call to an elevator car based upon relative ETA times.

* * * * *